US007492244B2

(12) United States Patent
Hamm

(10) Patent No.: US 7,492,244 B2
(45) Date of Patent: Feb. 17, 2009

(54) MAGNETICALLY ACTIVATED CONTACTING DEVICE

(75) Inventor: Wolfgang Hamm, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 11/458,574

(22) Filed: Jul. 19, 2006

(65) Prior Publication Data

US 2006/0244559 A1 Nov. 2, 2006

Related U.S. Application Data

(63) Continuation of application No. PCT/EP2005/000299, filed on Jan. 14, 2005.

(30) Foreign Application Priority Data

Jan. 20, 2004 (DE) ..... 10 2004 004016

(51) Int. Cl.
*H01H 9/00* (2006.01)

(52) U.S. Cl. ..... 335/205; 335/57; 335/71; 335/83; 335/97; 335/129; 335/130; 335/131; 335/132; 335/133; 335/156; 335/68; 335/196

(58) Field of Classification Search ..... 335/57, 335/71, 83, 97, 129–133, 156
See application file for complete search history.

(56) References Cited

U.S. PATENT DOCUMENTS 1,337,794 A * 4/1920 Reynolds et al. ..... 335/114
2,372,782 A * 4/1945 Holden ..... 335/136
2,522,715 A * 9/1950 Graybill et al. ..... 200/15
2,803,720 A 8/1957 Mason
2,844,656 A * 7/1958 Lohs ..... 335/109
2,935,583 A 5/1960 Howell
2,985,734 A * 5/1961 Howell et al. ..... 335/205
3,086,096 A * 4/1963 McGee ..... 335/133
3,106,626 A * 10/1963 Lord et al. ..... 335/133
3,139,496 A * 6/1964 Beller et al. ..... 335/126
3,192,342 A * 6/1965 Rovnyak et al. ..... 335/133
3,219,781 A * 11/1965 Miller et al. ..... 335/126
3,236,970 A * 2/1966 Ostrander et al. ..... 335/122

(Continued)

FOREIGN PATENT DOCUMENTS

DE 1143565 2/1963

(Continued)

OTHER PUBLICATIONS

German Search Report from German Application No. 102004004016.8 dated Dec. 1, 2004.

(Continued)

*Primary Examiner*—Elvin G Enad
*Assistant Examiner*—Mohamad A Musleh
(74) *Attorney, Agent, or Firm*—Alston & Bird LLP

(57) ABSTRACT

A code switch for an electrical appliance comprises triggering magnets at specific points in a rotatable rotor. Stationary opposite contacts are disposed in the housing of the code switch and wipers are provided with contact heads assigned to said opposite contacts at a disconnecting distance. When a triggering magnet is moved above an opposite contact by rotating the rotor, the contact head is pulled upward by magnetic force towards the opposite contact and the contact is closed.

18 Claims, 3 Drawing Sheets

U.S. PATENT DOCUMENTS

| | | | | |
|---|---|---|---|---|
| 3,239,629 | A * | 3/1966 | Lesser | 335/126 |
| 4,158,216 | A | 6/1979 | Bigelow | |
| 5,370,015 | A | 12/1994 | Moscatelli | |
| 6,771,154 | B1 * | 8/2004 | Funayama et al. | 335/159 |
| 6,958,895 | B1 * | 10/2005 | Radosavljevic et al. | 361/42 |
| 6,966,781 | B1 | 11/2005 | Bullinger et al. | |
| 7,046,109 | B2 * | 5/2006 | Lee | 335/133 |
| 2003/0230470 | A1 | 12/2003 | Galli | |

FOREIGN PATENT DOCUMENTS

| | | |
|---|---|---|
| DE | 1590371 | 6/1970 |
| DE | 8535821 | 2/1986 |
| DE | 290 743 | 6/1991 |
| DE | 10212953 | 10/2003 |
| FR | 1 330 818 | 6/1963 |
| GB | 410372 | 5/1934 |

OTHER PUBLICATIONS

International Search Report from PCT/EP2005/000299, dated May 4, 2005.

* cited by examiner

MAGNETICALLY ACTIVATED CONTACTING DEVICE

CROSS REFERENCE TO RELATED APPLICATIONS

This application claims priority from PCT application no. PCT/EP2005/000299, filed Jan. 14, 2005, which is based on German Application No. 102004004016.8, which was filed Jan. 20, 2004, of which the contents of both are hereby incorporated by reference.

FIELD OF APPLICATION AND PRIOR ART

The invention generally relates to a magnetically operated contacting device or switching device where contacts, such as signal or switching contacts, in the form of contact heads and opposite contacts, can be closed through the triggering action caused by magnetic force.

BACKGROUND OF THE INVENTION

DE 296 10 996 discloses an electromechanical connecting device. Two parts of the connecting device, which fundamentally correspond to the functions of plug and plug coupling, can be brought into mutual opposition in different positions. Only in a specific position does matching thereof take place as a result of mechanical coding in an intended manner. The closing of several contacts can only take place in this appropriate position as a result of magnetic coding by means of differently polled magnets positioned in a specific way. However, the use possibility is limited to producing in each case a single connection based on a single, specific pattern.

One problem addressed by the invention is to provide an aforementioned device which is able to obviate the disadvantages of the prior art, more particularly enabling a contacting device or switching device to be obtained for numerous switching or contacting functions with the aim of avoiding rubbing and the associated friction in the vicinity of the contacts despite the movement needed for producing the contacts.

BRIEF DEFINITION OF THE DRAWINGS

Embodiments of the invention are described in greater detail relative to the diagrammatic drawings, wherein.

DETAILED DESCRIPTION OF EMBODIMENTS

Figure 1:
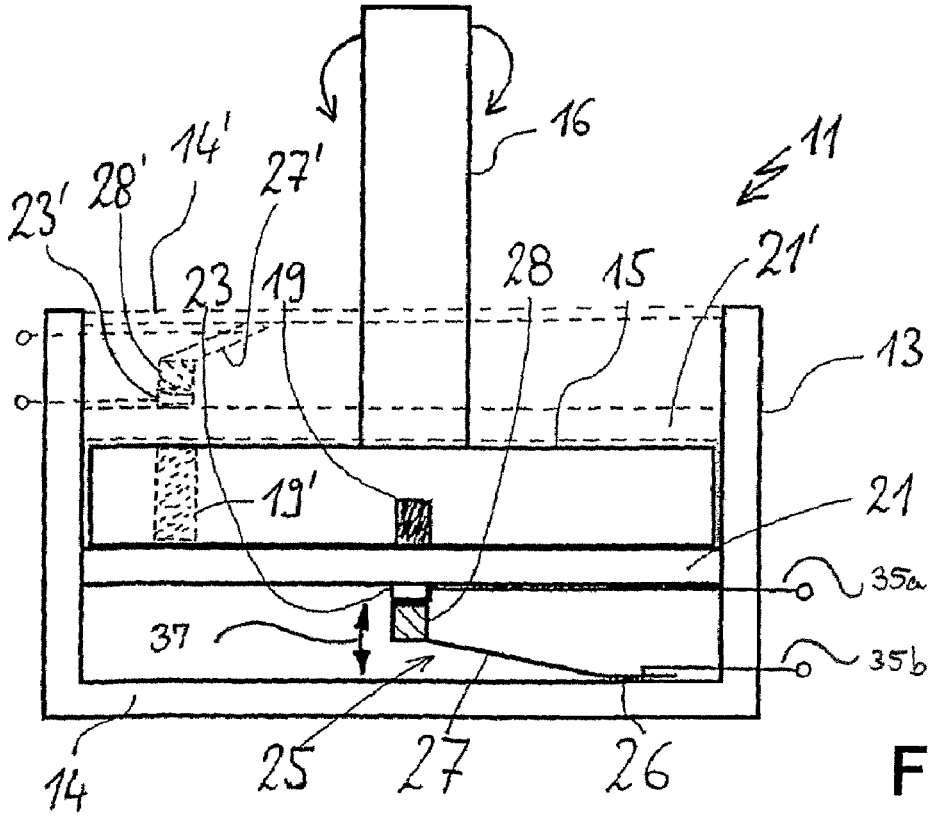
FIG. 1 illustrates a lateral section through a code switch implementing one embodiment of the invention.

In a simple version of a contacting device, a single triggering magnet can be provided. On the path of its relative movement to the wipers, the magnet can pass over the wipers. In the different activated positions, the magnet can bring a wiper(s) with the contact head against an associated opposite contact. In more complex constructions of the invention, several triggering magnets may be used. The magnets are advantageously juxtaposed or provided in a radially spaced manner. In one embodiment, the magnets are spaced apart in equal amounts, and can be positioned in a grid pattern. In the case of a rotor for accomplishing rotary movement, there can also be several circumferentially positioned triggering magnets, the angular distances being advantageously equal or in a given grid pattern.

In one arrangement, an opposite contact is located between the triggering magnet and contact head or wiper in an activated position. Thus, the triggering magnet draws the contact head towards it, and therefore against the opposite contact.

In this manner a linear or rotary movement can occur to the slider or wiper, similar to other code switches. As a function of whether there is an activated or deactivated position, one or more electrical contacts between a contact head on a wiper and an associated opposite contact are closed, for example in order to trigger specific signals associated with the given position. Through closing and opening the electrical contacts as a result of the magnetic force of the triggering magnets, it is possible to avoid or minimize rubbing on the electrical contacts thereof. This increases the reliability and service life of the contacting device.

A restoring force can be provided to separate the contacts by the omission of the magnetic attraction in a deactivated position. A springing-type force can be provided in the wipers resulting in a force to bring about a separation of the contacts and a resetting of the wipers. When the contacts are separated, there must be a separating distance, which is a function of the voltage applied to the contacts. Typically, this distance is several millimeters.

A wiper can be made from thin, flexible material. Preferably, the wiper is advantageously in one piece and may be, for example, in metal strip form. The wiper can be made of materials such as flexible copper, copper plated metals, or the like.

Several wipers can be provided, which are fashioned together in one piece or are interconnected. They are in particular electrically interconnected, for example, all to a signal source, which then furnishes a signal that is present on the different, opposite contacts. The wipers can be formed in one piece from a portion of material, for example a flat plate.

The contacts, or fixing points, of all the wipers can be in one plane. This should be parallel to the plane of the relative movement or the movement plane of the triggering magnets. If the opposite contacts are in a plane parallel thereto, the path to be covered by the wipers is the same in each case. The wipers can be constructed to as to have equal length, but constructions of different lengths are possible, particularly in order to construct a contacting device in space-saving and space-utilizing manner. The association between a contact head or wiper and an opposite contact is advantageously fixed in such a way that the same contact head only engages on the associated opposite contact.

In one embodiment, the wipers and opposite contacts are arranged in a fixed, defined manner on a contacting device, particularly on a support or housing thereof, and the triggering magnet is movable. For this purpose, the magnet can be located on a rotor for accomplishing rotary movement. The rotor can be provided with a rotation axis, on which can be coupled or mounted a manual handle, for example a rotary toggle. In other embodiments the handle can be a slider for accomplishing a sliding or linear movement. The rotor or slider can made, for example, from plastic with the triggering magnets fixed thereon. In one embodiment, the magnets are embedded into the rotor or slider. It is possible to mould the triggering magnets into the rotor to create an undetachable, invariable arrangement of the triggering magnets.

In a simple version of a contacting device, a single triggering magnet can be provided. On the path of its relative movement to the wipers, the magnet can pass over the wipers. In the different activated positions, the magnet can bring a wiper(s) with the contact head against an associated opposite contact. In more complex constructions of the invention, several triggering magnets may be used. The magnets are advantageously juxtaposed or provided in a radially spaced manner. In one embodiment, the magnet are spaced in an equal amount, and can be positioned in a grid pattern. In the case of a rotor for accomplishing rotary movement, there can also be several circumferentially positioned triggering magnets, the angular distances being advantageously equal or in a given grid pattern.

In one arrangement, opposite contact is located between the triggering magnet and contact head or wiper in an activated position. Thus, the triggering magnet draws the contact head towards it, and therefore against the opposite contact.

Contact heads or opposite contacts can be arranged in groups. Thus, during a rotary movement with the rotor, the contact heads or opposite contacts are located on a line through the rotation axis or on a line running vertical to the movement direction. These groups also advantageously have identical angular distances or are advantageously arranged in a grid pattern.

When there are several groups of wipers, independent modules can be provided for each group. In certain embodiments, it may be appropriate to place all the opposite contacts on a conducting layer. The opposite contacts can in film form, for example, with deposited or printed-on, conductive coatings. However, the opposite contacts are substantially electrically separated from one another and have external terminals or leads extending to the outside and which can be contacted by plug connections or the like. An interconnection of the opposite contacts can therefore advantageously take place by means of the external terminals, which makes the use of the module more universal.

These and further features can be gathered from the claims, description and drawings and the individual features, both singly or in the form of subcombinations, can be implemented in an embodiment of the invention and in other fields and can represent advantageous, independently embodiments for which protection is claimed here. The subdivision of the application into individual sections and the subheadings in no way restrict the general validity of the statements made thereunder.

Figure 4:
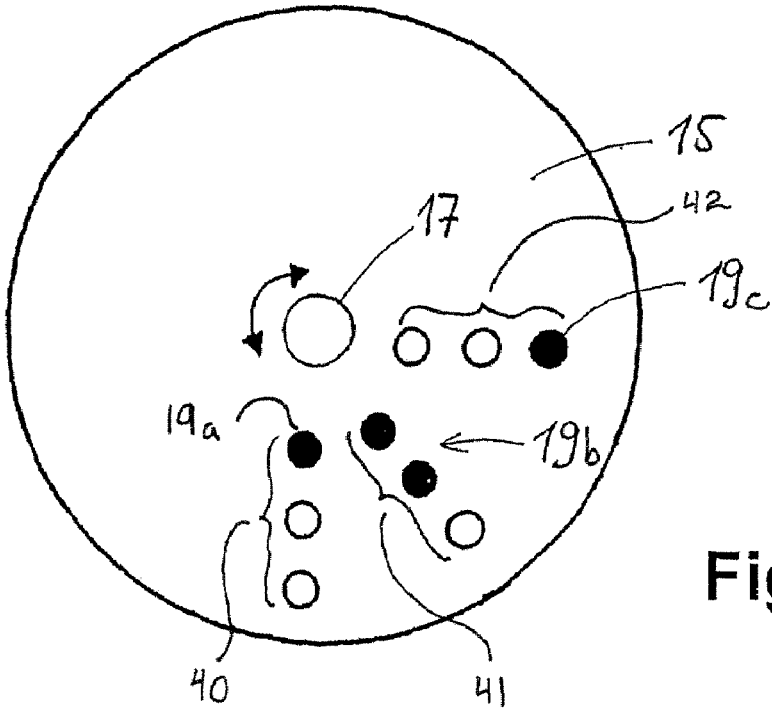
FIG. 4 illustrates a rotor with various possible groupings of magnets.

Turning to the figures, the code switch 11 in FIG. 1 has a cylindrical housing 13, in which is mounted in rotary manner a round rotor 15 with a shaft having a rotation axis 16, which is mounted on an pivot bearing 17 (see FIG. 4).

Figure 3:
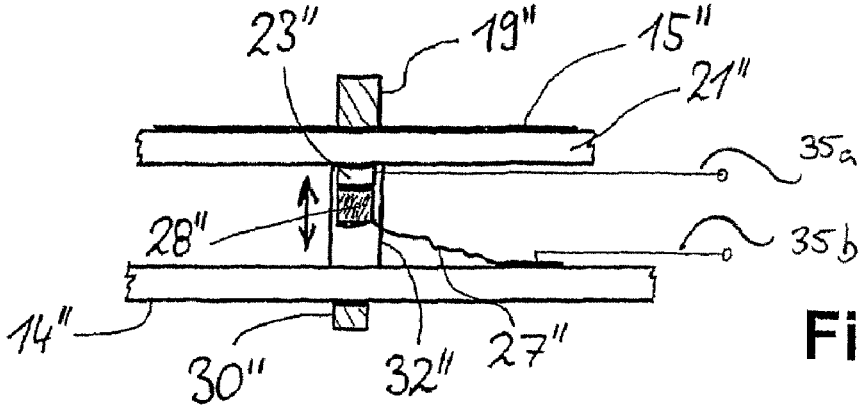
FIG. 3 illustrates a plan view of the rotor of FIG. 1 with triggering magnets.

Turning to FIG. 3 showing the plan view of the rotor 15, it can be seen how triggering magnets 19 having a cylindrical shape are provided in a distribution grid (see, e.g., the magnets shown as black circles 19*a*, 19*b*, 19*c* of FIG. 4). In FIG. 4, circles illustrate other points in the distribution grid where in alternative constructions the triggering magnets can be provided, but are not provided in the present case. Openings can also be provided here in which in the case of an individual construction of a rotor 15 further triggering magnets 19 can be provided. The triple rows shown in FIG. 4 can be distributed in the same way over the entire rotor 15 around rotation axis 16 with the represented rotation direction.

A partition 21 is provided in housing 13 below rotor 15 in FIG. 1. On the underside of the partition is provided an opposite contact 23, which projects downwards from said partition 21. It is provided with a symbolically represented, outwardly passing lead 35*a*.

Figure 2:
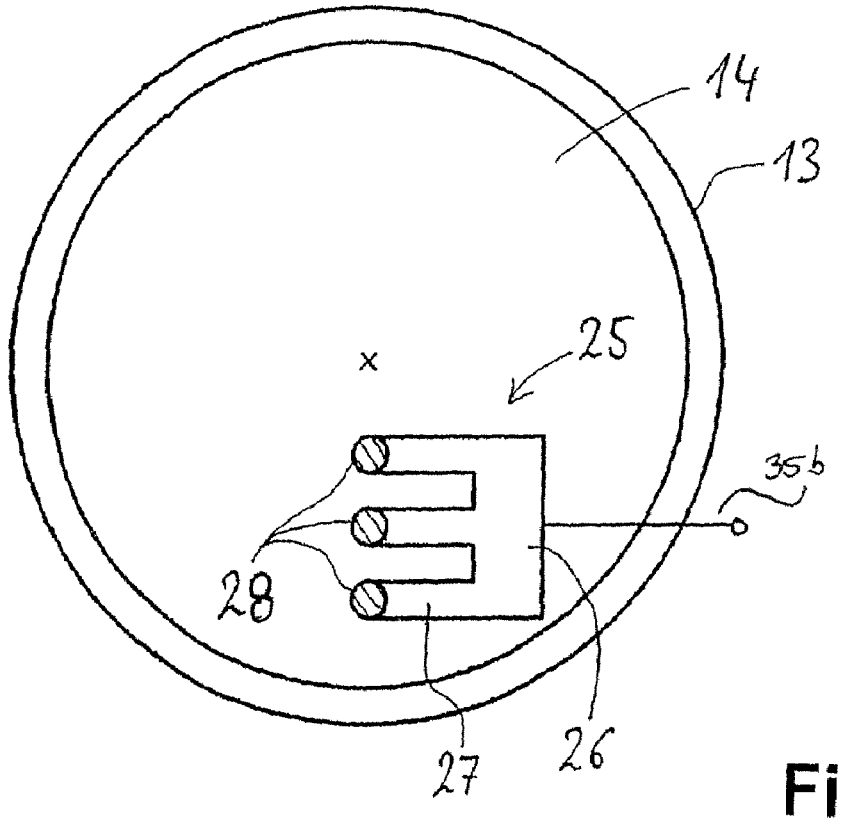
FIG. 2 illustrates a plan view on the part of FIG. 1 with wipers.

In the space between partition 21 and housing bottom 14 are so-called contact combs 25, which are also illustrated in FIG. 2. The contact combs 25 have contact arms or wipers 27 projecting from a common base 26. To the end thereof are fixed contact heads 28. Either the contact heads 28 or the associated areas of the wipers 27 are magnetic. The contact combs 25 are mechanically fixed to the housing bottom 14. As a result of the flexibility due to the limited material thickness of the contact combs, the wipers 27 can be moved upwards. This is illustrated by the movement arrow 37 with the two directions in FIG. 1. The contact heads 28 strike the facing opposite contacts 23, which are placed in fixed position on partition 21. The contact combs 25 are provided with electrical terminals or leads 35*b*, as symbolically illustrated in FIG. 1.

As is apparent from a comparison of FIGS. 2 and 3, the grid of the arrangement of the triggering magnets 19 of FIG. 3 corresponds to the placing of the contact heads 28 on wipers 27 according to FIG. 2. If the rotor 15 of FIG. 3 is now brought over the code switch 11 according to FIG. 2, then in the represented coincidence the radially inwardly positioned triggering magnet 19*a* of the first grouping 40 of FIG. 4, would draw upwards the radially inner wiper 27 with the associated contact head 28. The contact head 28 would engage on the associated opposite contact 23 producing an electrical contact similar to a relay. As a result of prebending, the remaining wipers 27 remain in a straight form on the housing bottom 14.

If rotor 15 is now further rotated clockwise by approximately 45 degrees in FIG. 3, the central grouping 41 of FIG. 4 of triggering magnets 19*b* is positioned precisely over the contact comb 25 or opposite contacts 23 and contact heads 28. Due to the fact that triggering magnets 19*b* are provided on both radially inner locations, the two radially inner wipers 27 are drawn upwards, so that the contact heads 28 fixed thereto engage on the opposite contacts 23. If the rotor 15 is rotated by a further amount, but less than 45 degrees, all the wipers 27 are pressed downwards again due to their springing force present in the wipers 27 and all the contacts are released. If the third grouping 42 of FIG. 4 with the individual, radially outwardly positioned triggering magnet 19*c* is located over the opposite contacts 23, exclusively the radially outer wiper 27 with contact head 28 is drawn upwards. Thus, once again the contact is closed, but against the radially outer opposite contact 23.

It is therefore clear that through the design of different arrangements of triggering magnets 19 in extension of the principle of FIG. 3, it is possible to provide a certain number of angular positions, for example eight or more, in which in each case some of the wipers 27 can be raised for closing the associated contacts and some are not in each case.

In place of the single contact comb 25 according to FIG. 2, there can be several contact combs, in certain circumstances also having different constructions, or in each case only individual wipers 27. For example, in FIG. 2 a further contact comb can be provided facing the rotation axis 16.

Figure 5:
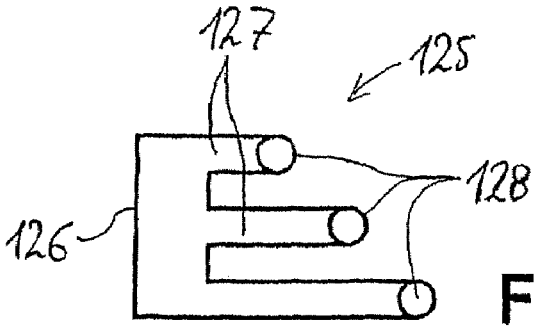
FIGS. 5-7 illustrate various embodiments of constructions for the contact combs wherein each embodiment incorporates a plurality of wipers.
Figure 6:
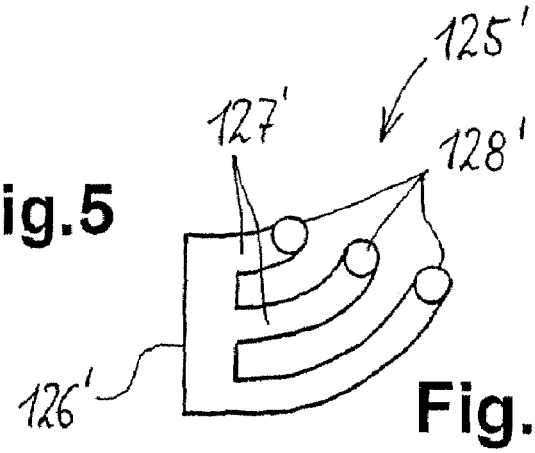
Figure 7:
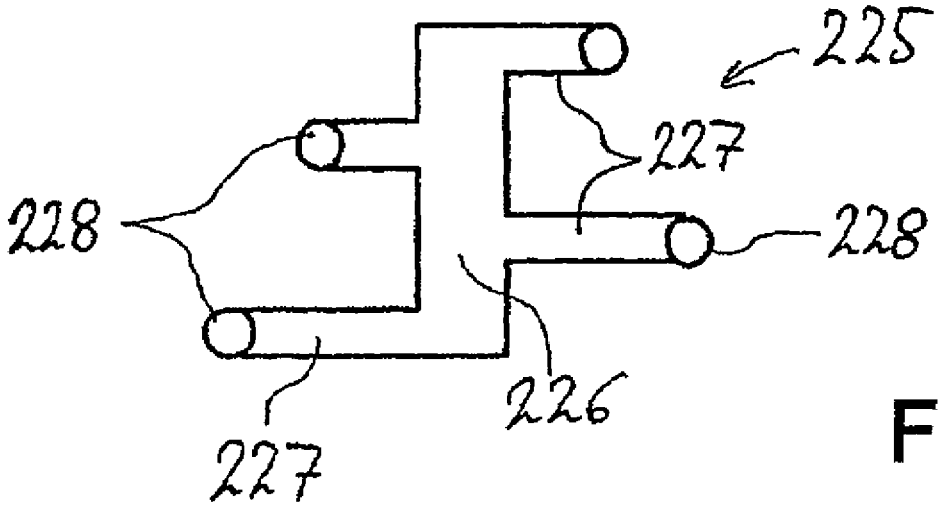

FIGS. 5-7 provide examples of further embodiments of contact combs 125 and 225. In FIG. 5 the wipers 127 are of different lengths and extend only in a single direction from the common base 126. In the case of contact comb 225 in FIG. 7, the wipers 227 of different lengths extend in both directions away from the common base 226. A contact head 228 is shown fixed to the end of the wiper 227.

The provision of several contact combs or several groups of wipers makes it possible to produce contacts in different areas, which may not be linearly arranged, or located in one area. Thus, different contact groups can be actuated in one rotor position. However, the use of this embodiment is a design selection of the code switch 11 with desired contacting pattern, which are dependent on a specific angular position of rotor 15.

As an alternative to a code switch 11 with a rotary movement, one skilled in the art can readily conceive how in a corresponding manner a sliding switch with a straight or also curved rocker arm can be produced. For this purpose it is merely necessary to separate the circular path of the rotor of FIG. 3 and redesign it as a straight or slightly curved path. Distributed along the sliding direction in a grid a sliding switch can have at random locations triggering magnets similar to those of FIG. 3. Along the sliding path can be provided one or more groups of wipers, for example also in the form of adhering contact combs according to FIG. 2. In specific sliding positions, those wipers or contact heads above which triggering magnets are located are raised and brought against opposite contacts. See FIGS. 7-9.

The invention claimed is:

1. A magnetically operated contacting device with at least two elongated wipers, each of elongated wiper being fixed at a first end and having at said first end an electrical connection, each of said elongated wipers having a second end with a magnetic area and a movable contact head, said movable contact head capable of contacting against a respective opposite contact, wherein at least two triggering magnets are provided which are movable to a first position and a second position relative to each of said elongated wiper, wherein said first position is an activated position in which said at least two triggering magnets attract said respective magnetic area of each of said elongated wiper and brings each said contact head in contact with said respective opposite contact, wherein said second position is a deactivated position in which each said contact head and said respective opposite contact are separated as a result of lack of magnetic attraction from said at least two triggering magnets, wherein said relative movement between said at least two triggering magnets is in a plane perpendicular relative to the movement direction of said movable contact head and said opposite contact.

2. The contacting device according to claim 1, wherein said relative movement of said at least two triggering magnets is a circular movement.

3. The contacting device according to claim 1, wherein a spring force is provided by each of said elongated wipers as a restoring force in order to move said contact head to said deactivated position when said at least two triggering magnets are moved away from said respective opposite contact.

4. The contacting device according to claim 3, wherein in said deactivated position there is a separating distance of at least one millimeter between each of said contact head and said respective opposite contact.

5. The contacting device according to claim 1, wherein each of said elongated wiper is made from a flexible material.

6. The contacting device according to claim 5, wherein said wiper is a metal strip.

7. The contacting device according to claim 1, wherein the at least two elongated wipers are constructed in one piece from one portion of material and are electrically interconnected.

8. The contacting device according to claim 1, wherein each of said contact heads of the least two elongated wipers are arranged in a plane parallel to a second plane in which said at least two triggering magnets are movable.

9. The contacting device according to claim 1, wherein said at least two triggering magnets are arranged on a rotor for accomplishing movement in an arc, wherein the rotor has a rotational axis with a manual handle and partially contained in a housing, wherein inside said housing each of said respective opposite contacts are arranged in a stationary manner.

10. The contacting device according to claim 9, wherein said rotor is made from plastic with the at least two triggering magnets embedded therein.

11. The contacting device according to claim 1, wherein the at least two triggering magnets are positioned in a radial manner.

12. The contacting device according to claim 1, wherein at least three triggering magnets are provided with identical relative spacings and the at least three triggering magnets are positioned in a circumferential manner.

13. The contacting device according to claim 1, wherein each one said opposite contact is located between said at least two triggering magnets and said respective contact head in said activated position.

14. The contacting device according to claim 1, wherein either said contact heads or said opposite contacts are arranged as a group in a plane perpendicular to a rotation axis.

15. The contacting device according to claim 14, wherein each of said contact heads or said respective opposite contacts are positioned with an identical angular amount relative to each other.

16. The contacting device according to claim 1, wherein said respective opposite contacts are provided on a conducting layer, electrically isolated from one another and connected to outwardly extending terminals.

17. A magnetically operated contacting device comprising:

a shaft rotating around an axis;

a rotor, connected to said shaft in a perpendicular manner capable of rotating around said axis into a first position and a second position;

a plurality of triggering magnets of a first number, each triggering magnet having a cylindrical shape affixed to said rotor in a radial pattern;

a housing in the shape of a cylinder having a partition therein, wherein said rotor is positioned parallel to a first side of said partition;

a plurality of stationary contact heads of a second number, wherein each contact head connected to a respective electrical lead, said plurality of stationary contact heads are located on a second side of said partition;

a plurality of wipers of said second number, wherein each wiper is elongated in shape and made from a flexible metal, said wiper comprising a first end and a second end, wherein each of said first end is fixed in position and connected to a common electrical lead and each of said second end has a respective moveable contact, wherein each of said respective moveable contact is located near a respective stationary contact head and capable of forming an electrical connection upon a bending movement of said wiper, wherein when said rotor is rotated to said first position, said plurality of trigger magnets are positioned so as to cause a corresponding movement of said moveable contacts based on magnetic attraction, causing said moveable contacts to form said electrical connection with said stationary contacts, and wherein when said rotor is rotated to said second position, said plurality of trigger magnets are separate from said stationary contacts based on a lack of magnetic attraction so as to not form said electrical connection with said stationary contacts.

18. The magnetically operated contacting device of claim 17 wherein the rotor is made of plastic.

* * * * *